US005541374A

United States Patent [19]

Sato et al.

[11] Patent Number: 5,541,374

[45] Date of Patent: Jul. 30, 1996

[54] RESONATOR TYPE SILENCER

[75] Inventors: Katsuhisa Sato, Kawagoe; Yuzo Shidara, Akishima; Soujirou Tanaka, Kamifukuoka, all of Japan

[73] Assignee: Tsuchiya Mfg. Co., Ltd., Tokyo, Japan

[21] Appl. No.: 412,905

[22] Filed: Mar. 29, 1995

[30] Foreign Application Priority Data

Mar. 31, 1994 [JP] Japan ..... 6-087444
Jul. 29, 1994 [JP] Japan ..... 6-197771

[51] Int. Cl.[6] ..... F01N 1/02

[52] U.S. Cl. ..... 181/250; 181/273; 181/276

[58] Field of Search ..... 181/229, 230, 181/250, 255, 273, 276

[56] References Cited

U.S. PATENT DOCUMENTS 4,874,062 10/1989 Yanagida et al. ..... 181/250

FOREIGN PATENT DOCUMENTS 60-12881 4/1985 Japan .
62-98716 6/1987 Japan .

*Primary Examiner*—Khanh Dang
*Attorney, Agent, or Firm*—Foley & Landner

[57] ABSTRACT

A resonator type silencer used in the air intake duct of an intake system of an internal combustion engine comprises a first case member which includes a generally cup-shaped section. A pipe section is integral with the cup-shaped section and extends through a bottom wall of the cup-shaped section. The pipe section has an inside portion located inside the cup-shaped section. An axially extending slit is formed in the inside portion of the pipe section. First and second flange portions are integral with the pipe section inside portion and located at opposite sides of the slit. The first and second flange portions are integral with the cup-shaped section bottom wall and located parallel with each other. The pipe section inside portion and the flange portions constitute an integral body having a first end face located near an open end of the cup-shaped section. A second case member is similar in structure to the first case member and has an integral body having a second end face located near an open end of the cup-shaped section. The open .end of the first cup-shaped section is securely connected to that of the second cup-shaped section, in which the first end face is located near the second end face. A seal member is secured to and extends along the first end face of the combined body of the first case member. The seal member has a lip section which extends along the length thereof and is in elastic contact with the second end face of the combined body of the second case member.

12 Claims, 4 Drawing Sheets

RESONATOR TYPE SILENCER

BACKGROUND OF THE INVENTION

1. Field of the Invention

This invention relates to improvements in a resonator type silencer installed in an intake system of an internal combustion engine or the like.

2. Description of the Prior Art

A resonator type silencer has been widely used in an intake system of an internal combustion engine in order to attenuate noise of intake air sucked into the engine. A typical resonator type silencer 51 is shown in FIG. 7 and includes a pair of case members 56, 56 usually made of a plastic and fabricated by an injection molding. Each case member 56 includes a cup-shaped section 55 having a bottom wall. A pipe section 54 is formed integral with the cup-shaped section 55 in a manner to pass through the bottom wall. The open ends 57 of the respective cup-shaped sections 55, 55 are brought into contact with and secured to each other, for example, by a vibration welding. The pipe sections 54, 54 are separate from each other inside the combined case members 56, 56. The pipe sections 54, 54 are connected to an air intake duct of the intake system. These separate pipe sections 54, 54 are connected to each other with a T-shaped connecting pipe or communication pipe 58 made of an elastomeric material such as a rubber. It will be understood that the T-shaped connecting pipe 58 is installed in position before combining the pair of case members 56, 56. Thus, an annular space 52 is formed around the pipe sections 54, 54 inside the cup-shaped section 55, 55. The annular space 52 is communicated with the inside the pipe sections 54, 54 thereby serving a resonance chamber to attenuate noise in the intake system.

However, drawbacks have been encountered in the above conventional resonance type silences in that the axes of the T-shaped pipe 58 and the pipe sections 54 unavoidably cannot be aligned under non-alignment of the axes of the case members 56, 56 during the welding of the open ends of the cup-shaped sections 55, 55. This forms an aperture or opening between the pipe section 54 and the T-shaped pipe 53. As a result, an air passage other than the communication pipe is unnecessarily formed, and therefore a predetermined resonance characteristics of the silencer is changed, thereby making it impossible to obtain an aimed resonance frequency for attenuating intake air noise. Additionally, since the T-shaped pipe is made of the elastomeric material, there is the possibility of being collapsed and deformed, thereby making the noise attenuating characteristics unstable. Furthermore, the welding of the open ends of the cup-shaped sections are made after the opposite ends of the T-shaped pipe are fitted on the opposite pipe sections, and therefore the operational efficiency of assembly of the silencer is degraded and it is difficult to maintain a precise fitting dimension of the T-shaped pipe to the pipe section, thus tending to produce a deflection or the like.

SUMMARY OF THE INVENTION

It is an object of the present invention to provide an improved resonator type silencer which can effectively overcome drawbacks encountered in similar conventional resonator type silencers.

Another object of the present invention is to provide an improved resonator type silencer which can stably exhibit a predetermined or aimed noise attenuating performance while being simple in construction so that the operational efficiency in an assembly process is high.

A further object of the present invention is to provide an improved resonator type silencer provided with a communication pipe (leading to a resonance chamber) which can be formed integral with the body of the silencer, thereby omitting an elastomeric communication pipe and a troublesome installation operation of the commuication pipe inside the body.

A resonator type silencer of the present invention comprises a first case member which includes a generally cup-shaped section. A pipe section is integral with the cup-shaped section and extends through a bottom wall of the cup-shaped section. The pipe section has an inside portion located inside the cup-shaped section. An axially extending slit is formed in the inside portion of the pipe section. First and second flange portions are integral with the pipe section inside portion and located at opposite sides of the slit. The first and second flange portions are integral with the cup-shaped section bottom wall and located parallel with each other. The pipe section inside portion and the flange portions constitute an integral body having a first end face located near an open end of the cup-shaped section. Additionally, a second case member is provided and includes a generally cup-shaped section. A pipe section is integral with the cup-shaped section and extending through a bottom wall of the cup-shaped section. The pipe section has an inside portion located inside the cup-shaped section. An axially extending slit is formed in the inside portion of the pipe section. First and second flange portions are integral with the pipe section inside portion and located at opposite sides of the slit. The first and second flange portions are integral with the cup-shaped section bottom wall and located parallel with each other. The pipe section inside portion and the flange portions constitute an integral body having a second end face located near an open end of the cup-shaped section. The open end of the first cup-shaped section is securely connected to that of the second cup-shaped section, in which the first end face is located near the second end face. A seal member is secured to and extends along the first end face of the integral body of the first case member. The seal member has a lip section which extends along the length of the seal member and is in elastic contact with the second end face of the integral body of the second case member.

According to present invention, the communication pipe for communicating the pipe sections with a resonance chamber is formed by providing the flange portions at the opposite sides of the slit of the pipe section and formed integral with the pipe section and the cup-shaped section. Therefore, there is no fear of causing an unstable and/or failed performances for noise attenuation due to leak through the communication pipe and/or deformation of the communication pipe. Additionally, since the silencer is constituted of a pair of case members and a seal member, a separate communication pipe is omitted, thereby rendering unnecessary an unreliable and troublesome step for fitting an elastomeric communication pipe before the assembly of the case members, thus facilitating the production of the silencer.

BRIEF DESCRIPTION OF THE DRAWINGS

In the drawings, like reference numerals designate like elements and parts throughout all figures, in which.

DETAILED DESCRIPTION OF THE INVENTION

Figure 1:
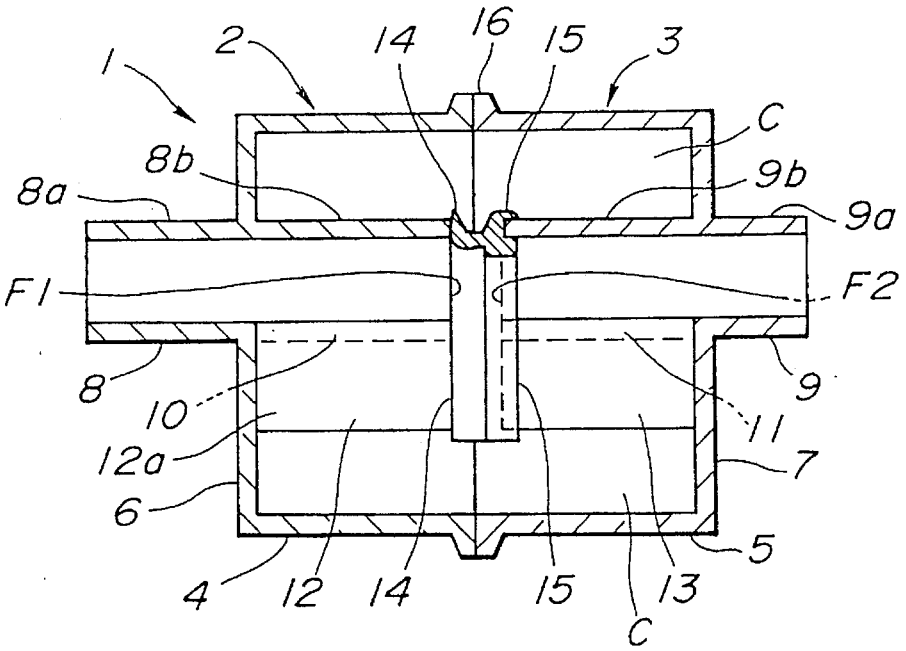
FIG. 1 is a vertical sectional view of a first .embodiment of a resonator type silencer according to the present invention.
Figure 2:
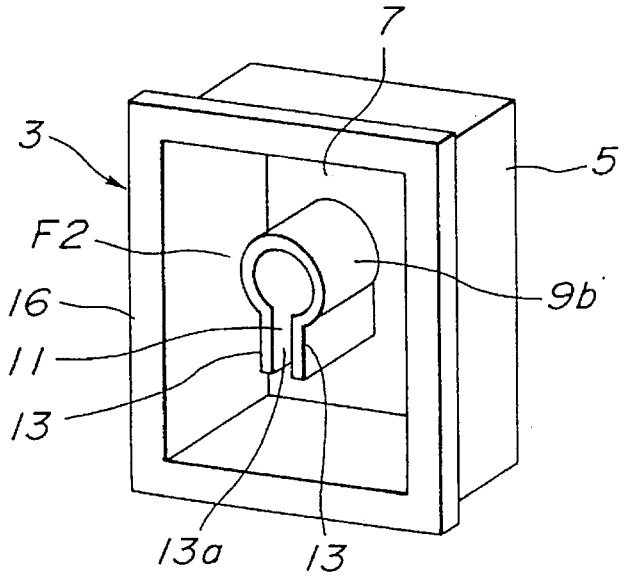
FIG. 2 is a perspective view of one of case members forming part of the silencer of FIG. 1.

Referring now to FIGS. 1 and 2, a first embodiment of a resonator type silencer according to-the present invention is illustrated by the reference numeral 1. The silencer 1 of this embodiment is installed in an intake system of an internal combustion engine though not shown. More specifically, the silencer 1 is assembled or disposed in an air intake duct forming part of the intake system.

The silencer 1 comprises two case members 2, 3 combined with each other by allowing them to contact with each other. Each case member 2, 3 is generally cup-shaped and has a generally rectangular cross-section. Each case member 2, 3 includes a cup-shaped section 4, 5 having a bottom wall 6, 7. A pipe section 8, 9 is formed integral with the cup-shaped section 4, 5 and extends through the bottom wall 6, 7 in such a manner that an axis thereof is perpendicular to the bottom wall 6, 7. Accordingly, the pipe section 8 of the case member 2 includes an outside portion 8*a* extending out of the cup-shaped section 4, and an inside portion 8*b* located inside the cup-shaped section 4 and extending from the bottom wall 6 toward the open end of the cup-shaped section 4. Similarly, the pipe section 9 of the case member 3 includes an outside portion 9*a* extending out of the cup-shaped section 5, and an inside portion 9*b* located inside the cup-shaped section 5 and extending from the bottom wall 7 toward the open end of the cup-shaped section 5. It will be understood that the outside portions 8*a*, 9*a* of the pipe sections 8, 9 are connected to the air intake duct of the intake system.

As clearly shown in FIG. 2, the inside portion 9*b* of the pipe section 9 is formed with a slit 11 located at the underside of the inside portion 9*b* and axially extends so that the inside portion 9*b* has a generally C-shape cross-section. In other words, the inside portion 9*b* has opposite end edges (no numerals)which are parallel with and spaced from each other to define the slit 11 therebetween. Additionally, two rectangular flange or plate portions 13, 13 are respectively integrally connected with the end edges of the inside portion 9*b*. The two flange portions 13, 13 are parallel with each other and extend vertically and longitudinally of the inside portion 9*b*, thereby defining therebetween a space 13*a* contiguous with or merging with the slit 11. Each flange portion 13 is integral at its one end with the bottom wall 7 and flushes at the other end with the end of the inside portion 9*b*, thereby forming a flat end face F2 of the integral body of the inside portion 9*b* and the flange portions 13, 13. The axis of the inside portion 9*b* of the pipe section 9 is perpendicular to the flat end face F2.

Similarly, though not clearly shown, the inside portion 8*b* of the pipe section 8 is formed with a slit 10 which is located at the underside of the inside portion 8*b* and axially extends so that the inside portion 8*b* has a generally C-shape cross-section. In other words, the inside portion 8*b* has opposite end edges (no numerals) parallel with and spaced from each other to define the slit 10 therebetween. Additionally, two rectangular flange or plate portions 12, 12 are respectively integrally connected with the end edges of the inside portion 8*b*. The two flange portions 12, 12 are parallel with each other and extend vertically and longitudinally of the inside portion 8*b* thereby defining therebetween a space 12*a* contiguous with or merging with the slit 10. Each flange portion 12 is integral at its one end with the bottom wall 6 and flush at the other end with the end of the inside portion 8*b*, thereby forming a flat end face F1 of the integral body of the inside portion 9*b* and the flange portions 12, 12. The axis of the inside portion 8*b* of the pipe section 8 is perpendicular to the flat end face F1. Accordingly, the shape of the flat end face F1 of the case member 2 is generally the same as that of the flat end face F2 of the case member 3.

Each case member 2, 3 is made of a synthetic resin or plastic and formed by an injection molding. The case member 2, 3 is not formed with an undercut and therefore can be readily fabricated by using only oppositely located metallic molds (not shown). The case member 2, 3 is formed at its open end with a rectangular joining face 16. The joining faces 16, 16 of the case member 2, 3 sealingly contact with each other and welded to each other, for example, by a vibration welding. In this state, as shown in FIG. 1, the flat end faces F1, F2 of the case members 2, 3 face with and spaced from each other to form a space therebetween.

A packing or seal member 15 made of a synthetic rubber is secured to the flat end face F2 of the integral body of the pipe section inside portion 9*b* and the flange portions 13, 13 along the whole length of the flat end face F2. The packing 15 is formed with an elongate lip section 14 which extends along the whole length of the packing 15. The lip section 14 is in elastic contact with the flat end face F1 of the integral body of the pipe section inside portion 8*b* and the flange portions 12, 12 at the whole length of the flat end face F1. The packing 15 is formed with an elongate groove (no numeral) located opposite to the lip section 14 and extends along the whole length of the packing 15. The end edge (including the flat end face F2) of the integral body of the pipe section inside portion 9*b* and the flange portions 13, 13 is fitted in the groove of the packing 15. The packing 15 may be secured to the flat end face F2 by using an adhesive, or by using an adhesive upon fitting the end edge of the integral body in the groove of the packing 15.

The distance between the flat end face F1 of the integral body of the pipe section inside portion 8*b* and the flange portions 12, 12 and the flat end face F2 of the integral body of the pipe section inside portion 9*b* and the flange portions 13, 13 is set such that the lip section 14 of the packing 15 is in contact with the flat end face F1 of the integral body of the pipe section inside portion 8*b* and the flange portions 12, 12 with a deflection allowance. In other words, the lip section 14 is in contact with the flat end face F1 upon being slightly deflected on the flat end face F1. It will be understood that a slight dimension error of the distance between the flat end faces F1 and F2 is negligible because it is compensated by the deflection of the lip section 14 of the packing 15, thereby effectively preventing a sealing connection between the flat end faces F1, F2 from being failed.

With the thus arranged resonator type silencer 1, the inside of the pipe sections 8, 9 are in communication with a chamber C (serving as a resonance chamber) formed around the pipe sections 8, 9, through the space 12*a*, 13*a* defined between the flange portions 12, 12; 13, 13. Accordingly, the flange portions 12, 13 serve as a communication pipe for communicating the inside of the pipe sections 8, 9 and the resonance chamber.

It will be understood that the cup-shaped sections 4 and 5 may be same as or different from each other in a depth (axial length) thereof. Additionally, the packing 15 may not lie at such a position that the extension of the joining surface 16 of the cup-shaped section 4, 5 passes through the packing 15.

Figure 3:
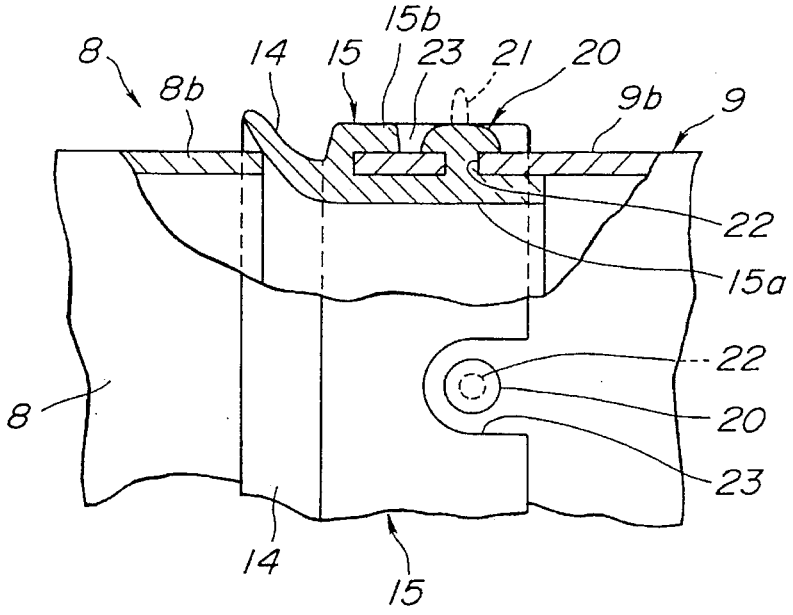
FIG. 3 is a fragmentary front elevation (partly in section) of an essential part of a second embodiment of the resonator type silencer according to the present invention.

FIG. 3 illustrates an essential part of a second embodiment of the silencer 1 according to the present invention, which is similar to the silencer 1 of FIGS. 1 and 2. In this embodiment, the flat end face F1 of the integral body of the pipe section inside portion 8*b* and the flange portions 12, 12 is sealingly connected through the packing 15 with the flat end face F2 of the integral body of the pipe section inside portion 9*b* and the flange portions 13, 13. The lip section 14 of the packing 15 is in elastic contact with the flat end face F1 with a deflection allowance.

In this case, the packing 15 has inner and outer wall sections 15*a*, 15*b* generally parallel with each other so that the tip end part (including the flat end face F2) of the integral body of the pipe section inside portion 9*b* and the flange portions 13, 13 is disposed therebetween. Thus, the inner and outer wall sections 15*a*, 15*b* constitute a double-wall structure. The inner wall section 15*a* is integrally formed with a plurality of rivet-like projections 20 each of which extends outwardly.

Each rivet-like projection 20 is formed of the same material as that of the packing 15 and includes a shaft section (no numeral) integral with the inner wall section 15*a*. Additionally, a head section (no numeral) is integral with the shaft section and larger in diameter than the shaft section. A pulling projection 21 is formed integral with the head section of the rivet-like projection 20. The rivet-like projection 20 is inserted from the inside of the pipe section inside portion 9*b* into an engagement hole 22 formed through the wall of the pipe section inside portion 9*b* and the wall of the flange portions 13, 13 by outwardly pulling the pulling projection 21, upon which the head sections of the rivet-like projections 20 are brought into positions outside of the wall of the pipe section inside portion 9*b* and the wall of the flange portions 13, 13 as shown in FIG. 3. After the rivet-like projections 20 are put into a state shown in FIG. 3, the pulling projection 21 is cut out. It will be understood that parts 23 (of the outer wall 15*b*) around the head sections of the rivet-like projections 20 are previously cut out in order to prevent interference of each rivet-like projection head section with the outer wall 15*b*.

Figure 4:
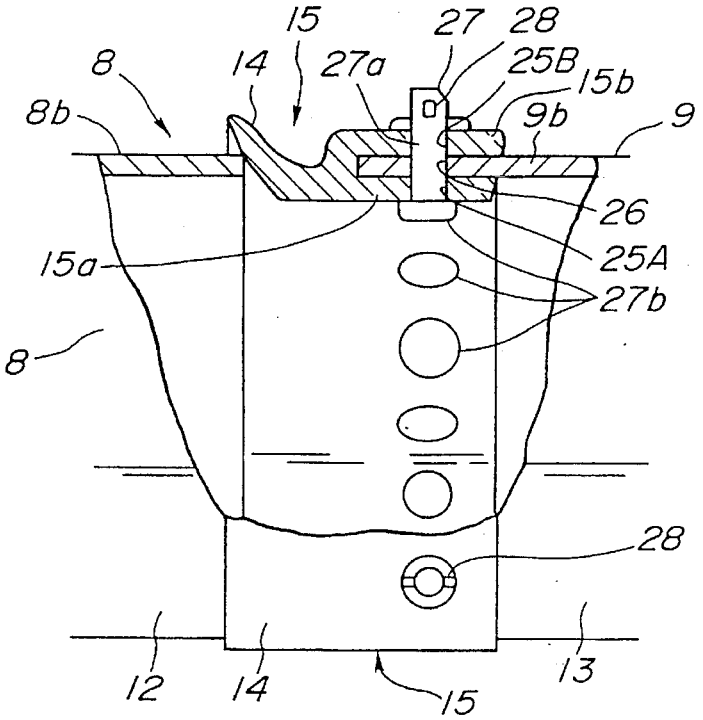
FIG. 4 is a fragmentary front elevation (partly in section) of an essential part of a third embodiment of the resonator type silencer according to the present invention.

FIG. 4 illustrates an essential part of a third embodiment of the silencer 1 according to the present invention, which is similar to that of FIG. 3. Also in this embodiment, the flat end face F1 of the integral body of the pipe section inside portion 8*b* and the flange portions 12, 12 is sealingly connected through the packing 15 with the flat end face F2 of the integral body of the pipe section inside portion 9*b* and the flange portions 13, 13. The lip section 14 of the packing 15 is in elastic contact with the flat end face F1 with a deflection allowance. Additionally, the packing 15 has the inner and outer wall sections 15*a*, 15*b* thereby constituting the double-wall structure.

A plurality of engagement holes 25A, 25B are formed respectively through the inner and outer wall sections 15*a*, 15*b*, in which the corresponding engagement holes 25A, 25B coincide with each other. Additionally, a plurality of engagement holes 26 are formed through the wall of the tip end part of the pipe section inside portion 9*b* and the flange portions 13, 13, in which each engagement hole 26 coincides with the above-mentioned corresponding engagement holes 25A, 25B.

A rivet-like engagement piece 27 is made of a metal and provided to fasten the packing 15 to the tip end part of the integral body of the pipe section inside portion 9*b* and the flange portions 13, 13. The engagement piece 27 includes a shaft section 27*a* inserted throughout the corresponding holes 25A, 25B, 26. The head section 27*b* of the engagement piece 27 is located inside of the inner wall 15*a* of the packing 15. The tip end portion (no numeral) of the shaft section 27*a* projects outside of the outer wall 15*b*. A pin 28 is inserted through the tip end portion of the shaft section 27*a* so that the engagement piece 27 is securely located in position. The engagement piece 27 may be securely located in position under a usual rivet fastening structure in which, for example, the tip end portion is caulked. It will be understood that fastening the packing 15 in position is improved by the fastening structures of FIGS. 3 and 4 over that of FIGS. 1 and 2, thereby omitting the possibility of the packing 15 getting out of the position under application of external force such as vibration, thus improving the durability of the silencer 1.

Figure 5:
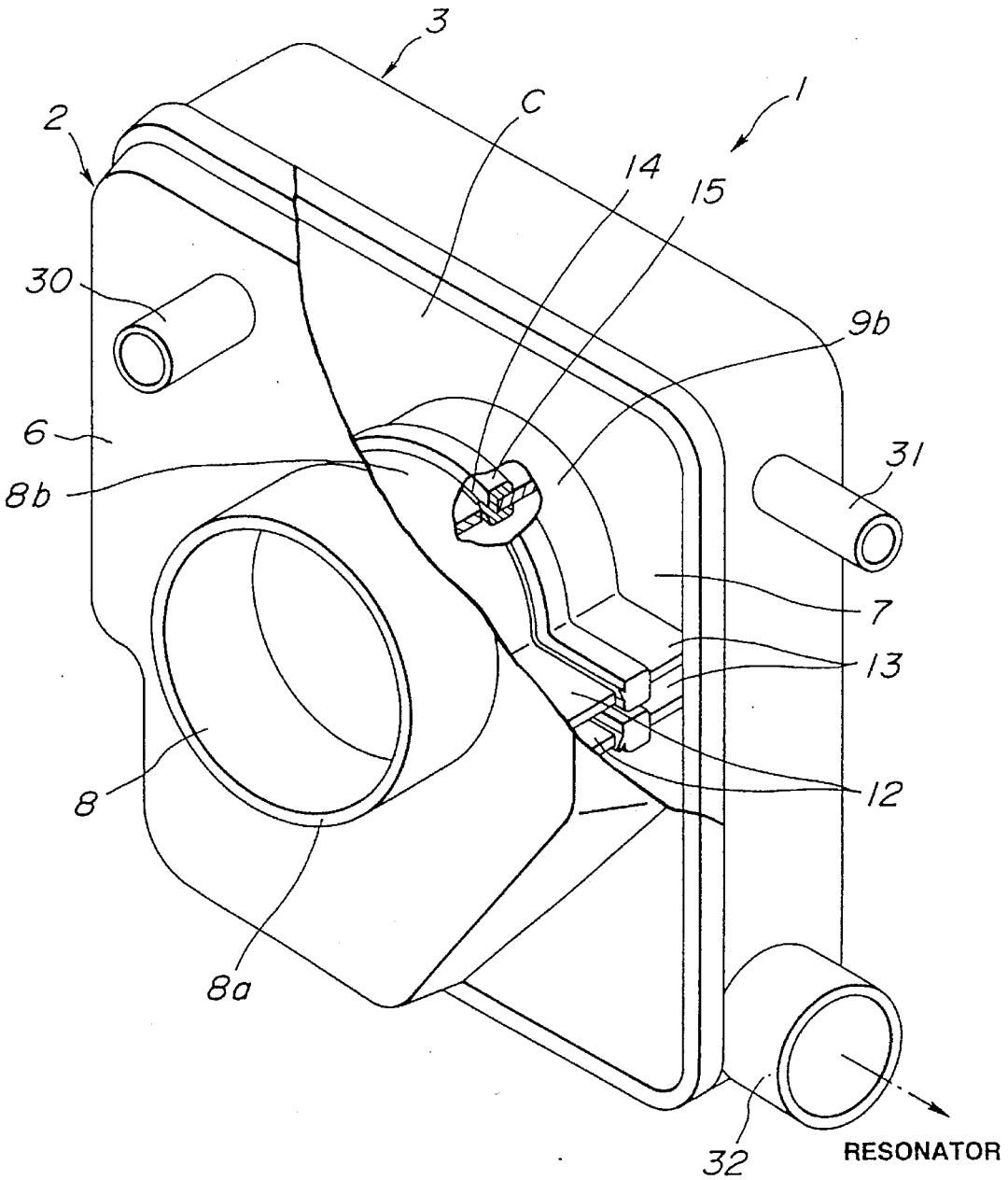
FIG. 5 is a perspective and partly broken view (partly in section) of a fourth embodiment of the resonator type silencer according to the present invention.
Figure 6:
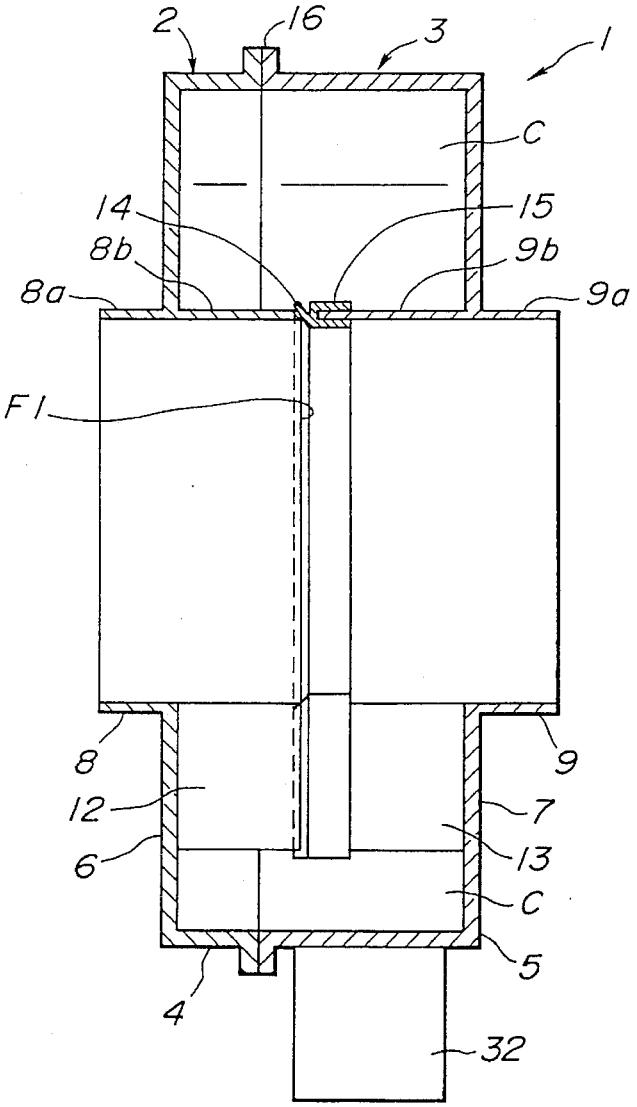
FIG. 6 is a vertical sectional view of the silencer of FIG. 5.
Figure 7:
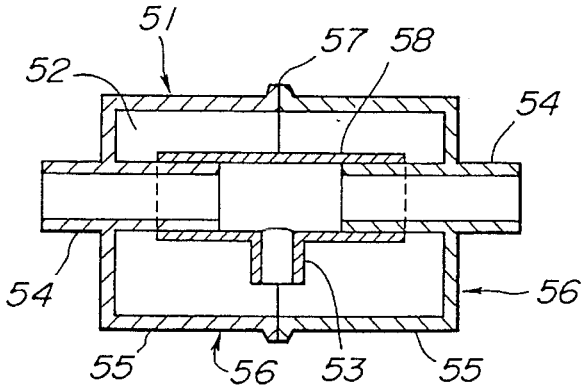
FIG.7 (PRIOR ART)
FIG. 7 is a vertical sectional view of a conventional resonator type silencer.

FIGS. 5 and 6 illustrate a fourth embodiment of the silencer 1 according to the present invention, similar to that of FIGS. 1 and 2. In this embodiment, the pipe section outside portion 8*a* of the case member 2 is connected to a throttle chamber (not shown) of the engine, whereas the pipe section outside portion 9*a* of the case member 3 is connected to an engine air cleaner (not shown). Additionally, the case member 2 is provided with a pipe 30 through which the chamber C formed around the pipe section inside portions 8*b*, 9*b* is communicated with a pipe (not shown) through which auxiliary air is supplied to the engine. Additionally, the case member 3 is provided with a pipe 31 through which the chamber C is communicated with a blow-by gas return pipe of the air cleaner. A duct 32 is provided to the case member 3 in a manner to allow the chamber C to be communicated with a resonator (not shown).

What is claimed is:

1. A resonator type silencer comprising:

a first case member including a generally cup-shaped section, a pipe section integral with said cup-shaped section and extending through a bottom wall of said cup-shaped section, said pipe section having an inside portion located inside said cup-shaped section, means defining an axially extending slit in the inside portion of said pipe section, first and second flange portions integral with said pipe section inside portion and located at opposite sides of said slit, said first and second flange portions being integral with said cup-shaped section bottom wall and located parallel with each other, said pipe section inside portion and said flange portions constituting an integral body having a first end face located near an open end of said cup-shaped section;

a second case member including a generally cup-shaped section, a pipe section integral with said cup-shaped section and extending through a bottom wall of said cup-shaped section, said pipe section having an inside portion located inside said cup-shaped section, means defining an axially extending slit in the inside portion of said pipe section, first and second flange portions integral with said pipe section inside portion and located at opposite sides of said slit, said first and second flange portions being integral with said cup-shaped section bottom wall and located parallel with each other, said pipe section inside portion and said flange portions constituting an integral body having a second end face located near an open end of said cup-shaped section;

means by which the open end of said first cup-shaped section is securely connected to that of said second cup-shaped section so that the first end face is located near the second end face; and a seal member secured to and extending along the first end face of said integral body of said first case member, said seal member having a lip section which extends along the length of said seal member and is in elastic contact with the second end face of said integral body of said second case member.

2. A resonator type silencer as claimed in claim 1, wherein said seal member is formed of an elastomeric material.

3. A resonator type silencer as claimed in claim 1, wherein the first and second end faces of the integral bodies of said first and second case members are separate from each other in a state the open ends of the cup-shaped sections of said first and second case members are connected to each other.

4. A resonator type silencer as claimed in claim 1, wherein said seal member defines an inner chamber within said pipe section inside portions of said first and second case members.

5. A resonator type silencer as claimed in claim 4, wherein the open ends of said cup-shaped sections of said first and second case members are sealingly securely connected with each other to define an outer chamber around said pipe section inside portions of said first and second case members.

6. A resonator type silencer as claimed in claim 5, wherein the first and second flange portions of said first and second case members define therebetween a space through which said inner chamber is communicated with said outer chamber.

7. A resonator type silencer as claimed in claim 1, wherein said seal member includes means defining a groove which is located opposite to said lip section and extends along the length of said seal member, a tip end part of said integral body of said first case member being fitted in said groove.

8. A resonator type silencer as claimed in claim 1, further comprising means defining a plurality of engagement holes in said integral body of said first case member, and a plurality of engagement pieces which respectively pass through said engagement holes to secure said seal member to said integral body of said first case member, each engagement piece having an enlarged head section located outside the wall of said integral body.

9. A resonator type silencer as claimed in claim 8, wherein each engagement piece is integral with said seal member and formed of a material which is same as that of said seal member.

10. A resonator type silencer as claimed in claim 8, wherein each engagement piece is a rivet-like member passing through the wall of said seal member and the corresponding engagement hole of said integral body.

11. A resonator type silencer as claimed in claim 1, wherein said seal member has first and second walls which extend along the length of said seal member and are spaced from each other defining therebetween a deep groove in which the tip end part of said integral body of said first case member is fitted.

12. A resonator type silencer as claimed in claim 5, further comprising means for allowing said outer chamber to be communicated with a resonator separate from said first and second case members.

* * * * *